US007432030B2

(12) United States Patent
Tsurumi et al.

(10) Patent No.: US 7,432,030 B2
(45) Date of Patent: Oct. 7, 2008

(54) TONER FOR DEVELOPING ELECTROSTATIC LATENT IMAGE, DEVELOPER FOR DEVELOPING ELECTROSTATIC LATENT IMAGE, AND PROCESS FOR PRODUCING TONER FOR DEVELOPING ELECTROSTATIC LATENT IMAGE

(75) Inventors: Yosuke Tsurumi, Kanagawa (JP); Akira Matsumoto, Kanagawa (JP); Mayuko Uda, Kanagawa (JP); Hiroshi Nakazawa, Kanagawa (JP); Kazufumi Tomita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 370 days.

(21) Appl. No.: 11/079,646

(22) Filed: Mar. 15, 2005

(65) Prior Publication Data

US 2006/0057484 A1 Mar. 16, 2006

(30) Foreign Application Priority Data

Sep. 15, 2004 (JP) ..... 2004-268151

(51) Int. Cl.
*G03G 9/08* (2006.01)

(52) U.S. Cl. ..... 430/108.8; 430/108.1

(58) Field of Classification Search ..... 430/108.8, 430/108.1

See application file for complete search history.

(56) References Cited

U.S. PATENT DOCUMENTS 5,840,459 A * 11/1998 Ohno et al. ..... 430/108.4
6,203,959 B1 * 3/2001 Tanikawa et al. ..... 430/108.8
2002/0076636 A1 * 6/2002 Uchida et al. ..... 430/108.4
2005/0175923 A1 * 8/2005 Nakazawa et al. ..... 430/110.3

FOREIGN PATENT DOCUMENTS

| | | |
|---|---|---|
| JP | 63-282752 | 11/1988 |
| JP | 05-61239 | 3/1993 |
| JP | 06-67504 | 3/1994 |
| JP | 06-250439 | 9/1994 |
| JP | 08-152735 | 6/1996 |
| JP | 2000-3077 | 1/2000 |
| JP | 2000-321815 | 11/2000 |

* cited by examiner

*Primary Examiner*—John L Goodrow
(74) *Attorney, Agent, or Firm*—Oliff & Berridge, PLC

(57) ABSTRACT

A toner for developing an electrostatic latent image includes a binder resin, a colorant and a releasing agent. The releasing agent contains a hydrocarbon component including a linear hydrocarbon component, and the liner hydrocarbon component has a carbon number distribution and an average carbon number N. An amount of a component having a carbon number of from N−4 to N+4 in the releasing agent is 80% by mass or more based on the total mass of the hydrocarbon component of the releasing agent. An amount of a component having a carbon number of N−10 or less in the releasing agent is 0.05% by mass or less based on the total mass of the hydrocarbon component of the releasing agent, and an amount of a component having a carbon number of N+10 or more in the releasing agent is 0.05% by mass or less based on the total mass of the hydrocarbon component of the releasing agent.

18 Claims, No Drawings

TONER FOR DEVELOPING ELECTROSTATIC LATENT IMAGE, DEVELOPER FOR DEVELOPING ELECTROSTATIC LATENT IMAGE, AND PROCESS FOR PRODUCING TONER FOR DEVELOPING ELECTROSTATIC LATENT IMAGE

BACKGROUND OF THE INVENTION

1. Field of the Invention

The present invention relates to a toner and a developer for developing an electrostatic latent image used in such a process as an electrophotographic process and an electrostatic recording process.

2. Description of the Related Art

The image forming process by visualization of image information through an electrostatic latent image by the electrophotographic system (hereinafter, sometimes referred to as an electrostatic image) has been used in various fields of art. A technique for providing higher image quality is being demanded according to the digitalization and progress in image processing techniques in recent years.

In reaction to the demand of higher image quality, a toner for developing an electrostatic image has been improved to have a smaller particle diameter and a uniform particle size distribution. However, there is a limitation in reducing the particle diameter by the conventional kneading and pulverizing process, and the uniformization in particle size distribution is still insufficient for obtaining higher image quality even by using a classification step.

Such characteristics are being also strongly demanded in the toner for developing an electrostatic image, as electric power saving, energy saving, low cost and prolonged service life, in view of environmental protection. In order to attain the demand, for example, from the standpoint of the fixing technique, the prolonged service life is attained by oilless fixing, and the energy saving and low cost are attained by fixing at a low temperature and a high speed. As a practical method for attaining the techniques, such a method is being generally practiced that a releasing agent, such as wax, is contained in a toner to impart a releasing effect to the toner itself.

However, the structure and the addition amount of the releasing agent are difficult to control by the conventional kneading and pulverizing process, as similar to the case of obtaining higher image quality, and thus it is the current situation that the demand cannot be attained by these measures.

As a method for intentionally controlling the structure of a toner for developing an electrostatic image, JP-A-63-282752 and JP-A-6-250439 propose processes for producing a toner by the emulsion polymerization aggregation process. In these processes, a resin dispersion liquid is produced by the emulsion polymerization method, and separately, a colorant dispersion liquid is produced by dispersing a colorant in a solvent. The dispersion liquids are then mixed to form aggregated bodies having a diameter corresponding to the toner diameter, which are then fused and integrated by heating. In the process, the shape of the toner can be controlled to some extent to improve the charging property and the durability. However, the toner has a substantially uniform interior structure, and thus there are problems remaining in the releasing property of a fixing sheet upon fixing, and the fixing property at a low temperature and a high speed.

JP-A-5-61239 proposes a toner for oilless fixing containing a large amount a releasing agent component encompassed in the toner. However, the releasing property can be improved to some extent owing to the large amount of the releasing agent added, but the releasing agent cannot be exuded stably and uniformly due to the compatibility between the binder component and the releasing agent, and thus stable releasing property cannot be obtained. Furthermore, the compatibility of the releasing agent with the binder component lowers the glass transition temperature of the toner, which deteriorates the storage stability and the document offset property. The dispersing properties of the materials inside the toner exert great influence not only on the characteristics of the fixed image, such as the adhesion property to paper, the releasability from the fixing roll, the flexural resistance after fixing and the gloss, but also on total fixing property of the toner, such as the OHP transparency.

A method for improving the fixing property by defining the components and the melting heat amount is proposed. As a method for improving the fixing property by defining the carbon number of the releasing agent, for example, JP-A-8-152735 proposes a toner having good fixing property and causing less filming by defining the carbon number of the releasing agent and the proportion of a linear hydrocarbon. However, the fixing capability at high speed cannot be sufficiently obtained by the carbon number defined in the toner, and the tendency is conspicuous in oilless fixing.

As a method for improving the fixing property by defining the melting heat amount of the releasing agent, for example, JP-A-2000-3077 and JP-A-6-67504 propose such a toner that the wax used as the releasing agent of the toner is defined in melting heat amount to improve the offset resistance. However, the wax cannot be stably exuded upon fixing due to the compatibility between the binder component of the toner and the wax, and improvement cannot be necessarily obtained in hot offset. The tendency is conspicuous in oilless fixing. Furthermore, no sufficient effect is obtained on deterioration in storage stability of the toner and the resulting image due to the reduction in glass transition temperature of the toner by the wax.

As a method for improving the fixing property by defining the components of the releasing agent, for example, JP-A-2000-321815 proposes such a toner that the proportion of a normal paraffin and the DSC endothermic curve of the toner are defined to improve the fixing property, the storage stability, the flowability and the durability. However, the method can improve the plasticizing effect to the binder resin of the toner to improve the fixing property, the storage stability, the flowability and the durability to some extent, but the improvements in the method are not necessarily satisfactory.

SUMMARY OF THE INVENTION

The present invention has been made in view of the above circumstances and provides a toner for developing an electrostatic latent image, a developer for developing an electrostatic latent image, and a process for producing a toner for developing an electrostatic latent image. In other words, the invention is to provide such a toner and a developer for developing an electrostatic latent image that exert excellent capability on the storage stability of the toner and the storage stability of an image obtained on high speed fixing and oilless fixing. The invention is also to provide a process for producing the toner for developing an electrostatic latent image.

According to a first aspect of the invention, a toner for developing an electrostatic latent image, includes: a binder resin; a colorant; and a releasing agent, the releasing agent contains a hydrocarbon component including a linear hydrocarbon component, in which, the liner hydrocarbon component has a carbon number distribution and an average carbon number N, an amount of a component having a carbon number of from N−4 to N+4 in the releasing agent is 80% by mass or more based on the total mass of the hydrocarbon component of the releasing agent, an amount of a component having a carbon number of N−10 or less in the releasing agent is 0.05% by mass or less based on the total mass of the hydrocarbon component of the releasing agent, and an amount of a component having a carbon number of N+10 or more in the releasing agent is 0.05% by mass or less based on the total mass of the hydrocarbon component of the releasing agent.

According to a second aspect of the invention, a toner for developing an electrostatic latent image, includes: a binder resin; a colorant; and a releasing agent, the releasing agent contains a hydrocarbon component which includes a linear hydrocarbon component and a branched hydrocarbon component, in which an amount of a component having a carbon number of 40 or less in the branched hydrocarbon component is 2% by mass or less based on the total mass of the hydrocarbon component of the releasing agent, the releasing agent has a melting point of from 70 to 100° C., and the toner has a melting heat amount derived from the releasing agent of 17 J/g or less measured with a DSC.

According to a third aspect of the invention, A toner for developing an electrostatic latent image, includes: a binder resin; a colorant; and a releasing agent, the releasing agent contains a hydrocarbon component which includes a linear hydrocarbon component and a branched hydrocarbon component, in which, an amount of the linear hydrocarbon component in the releasing agent is 70% by mass or more based on the total mass of the hydrocarbon component of the releasing agent, the branched hydrocarbon component has a carbon number distribution, an amount of a component of the branched hydrocarbon component having a carbon number of 40 or less in the releasing agent is 2% by mass or less based on the total mass of the hydrocarbon component of the releasing agent, and the releasing agent has an endothermic curve measured with a DSC, in which a ratio (b/a×100) is 2.5 or less, where a (J/g) represents an endothermic amount per unit amount at 50° C. or lower, and b (J/g) represents a total endothermic amount per unit amount.

The toner for developing an electrostatic latent image according to the invention exerts excellent capability in high speed fixing, storage stability, flowability, thermal stability and document offset, and in particular, the toner exerts excellent capability in hot offset preventing property.

The toner of the invention can stably form a high quality image with excellent heat resistance without image defects for a prolonged period of time.

DETAILED DESCRIPTION OF THE PREFFERED EMBODIMETNTS

While the invention has been described in detail and with reference to specific embodiments thereof, it will be apparent to one skilled in the art that various changes and modifications can be made without departing from the scope thereof.

This application is based on Japanese patent application No. 2004-268151 filed on Sep. 15, 2004, the entire contents thereof being hereby incorporated by reference.

The toner for developing an electrostatic latent image, the developer for developing an electrostatic latent image, and the process for producing the toner for developing an electrostatic latent image according to the invention will be described in detail below.

The toner for developing an electrostatic latent image (hereinafter, sometimes simply referred to as a toner) according to the invention contains at least a binder resin, a colorant and a releasing agent.

The toner for developing an electrostatic latent image according to the first aspect of the invention contains at least a binder resin, a colorant and a releasing agent, the releasing agent contains a hydrocarbon component including a linear hydrocarbon component, and the liner hydrocarbon component has an average carbon number N and a carbon number distribution, in which an amount of a component having a carbon number of from N−4 to N+4 in the releasing agent is 80% by mass or more based on the total mass of the hydrocarbon component of the releasing agent, an amount of a component having a carbon number of N−10 or less in the releasing agent is 0.05% by mass or less based on the total mass of the hydrocarbon component of the releasing agent, and an amount of a component having a carbon number of N+10 or more in the releasing agent is 0.05% by mass or less based on the total mass of the hydrocarbon component of the releasing agent.

The releasing agent used in the invention contains a hydrocarbon component. The hydrocarbon component contains a linear hydrocarbon component and, as an arbitrary component, a branched hydrocarbon component.

The linear hydrocarbon component has a carbon number distribution measured by gas chromatography, in which a component having a carbon number of from N−4 to N+4 occupies 80% by mass or more based on the total mass of the hydrocarbon component of the releasing agent, and a component having a carbon number of N−10 or less or N+10 or more occupies 0.05% by mass or less based on the total mass of the hydrocarbon component of the releasing agent, where N represents the average carbon number of the linear hydrocarbon component. The component having a carbon number of from N−4 to N+4 preferably occupies from 85 to 100% by mass based on the total mass of the hydrocarbon component of the releasing agent.

In the case where the component having a carbon number of from N−4 to N+4 occupies 80% by mass or more based on the total mass of the hydrocarbon component of the releasing agent, the releasing agent is quickly melted upon melting the toner to provide stable releasing property upon high speed fixing. In the case where the component having a carbon number of N−10 or less or N+10 or more occupies 0.05% by mass or less based on the total mass of the hydrocarbon component of the releasing agent, the releasing agent is quickly melted upon melting the toner, and also quickly solidified after fixing, so as to prevent favorably an image from being nonuniform.

The linear hydrocarbon component and the branched hydrocarbon component described later can be quantitatively determined by using a gas chromatography apparatus, GC-17A, produced by Shimadzu Corp. The column used has polycarborane-siloxane as a liquid phase, a film thickness of 0.1 μm, an inner diameter of 0.25 mm and a length of 15 mm, and a flame ionization detector (FID) is used as a detector. Upon measurement, the temperature of the column thermostatic bath is increased from 60° C. as the initial temperature at a temperature increasing rate of 40° C. per minute to 160° C., then increased at a rate of 15° C. per minute to 350° C., and then increased at a rate 7° C. per minute to 455° C., followed by being held at 455° C. for 4 minutes. The temperature of the vaporizing chamber is increased from 70° C. as the initial temperature at a temperature increasing rate of 250° C. per minute to 445° C., followed by being held at 455° C. until completion of the measurement. The detector is held at 445°

C. over the measurement. The sample to be measured is dissolved in isooctane as a solvent to a concentration of 0.1% by mass.

The average carbon number of the linear hydrocarbon component of the releasing agent is preferably from 35 to 60, and more preferably from 40 to 55.

In the case where the average carbon number is in the aforementioned range, the releasing agent is favorably melted to facilitate fixing, and the toner obtained is excellent in powder characteristics and filming property and thus can be favorably used for high speed fixing.

The toner for developing an electrostatic latent image according to the second aspect of the invention contains at least a binder resin, a colorant and a releasing agent, the releasing agent contains a hydrocarbon component which includes a linear hydrocarbon component and a branched hydrocarbon component, in which an amount of a component having a carbon number of 40 or less in the branched hydrocarbon component is 2% by mass or less based on the total mass of the hydrocarbon component of the releasing agent, the releasing agent has a melting point of from 70 to 100° C., and the toner has a melting heat amount derived from the releasing agent of 17 J/g or less measured with a DSC.

In the releasing agent used in the invention, the amount of the component having a carbon number of 40 or less in the branched hydrocarbon component is 2% by mass or less, and preferably 1% by mass or less, based on the total mass of the hydrocarbon component. In the case where the amount of the component having a carbon number of 40 or less in the branched hydrocarbon component is 2% by mass or less based on the total mass of the hydrocarbon component, the releasing agent has good compatibility with the binder resin of the toner, less affects the glass transition temperature Tg of the toner, and prevents deterioration of the storage stability and the flowability of the toner, and the storage stability and the document offset of the image obtained.

The releasing agent has a melting point of from 70 to 100° C., and preferably from 85 to 95° C. In the case where the melting point is 70° C. or more, the toner has good thermal stability. In the case where the melting point is 100° C. or less, the releasing agent is good in exuding property upon fixing to provide good capability in hot offset preventing property. Accordingly, in the case where the releasing agent has a melting point of from 70 to 100° C., good capability in hot offset preventing property can be obtained without deterioration in thermal stability of the toner to provide a well balanced toner for developing an electrostatic latent image.

The toner for developing an electrostatic image has a melting heat amount derived from the releasing agent of 17 J/g or less, preferably from 10 to 17 J/g, and more preferably from 12 to 17 J/g, as measured with a DSC. In the case where the melting heat amount derived from the releasing agent is 17 J/g or less, the releasing agent is melted and exuded with low energy upon fixing to enable fixing at a low temperature, a high speed and a low pressure, and it is advantageous for oilless fixing to obtain long service life and high reliability.

The measurement of the melting point and the melting heat amount can be effected by using a differential scanning calorimeter, DSC-60, produced by Shimadzu Corp. The temperature compensation of the detector of the apparatus is effected by utilizing the melting points of indium and zinc, and the compensation of the amount of heat is effected by using the melting heat amount of indium. The sample to be measured is placed on an aluminum pan and measured at a temperature increasing rate of 10° C. per min with a blank pan for reference.

The toner for developing an electrostatic latent image according to the third aspect of the invention contains at least a binder resin, a colorant and a releasing agent, the releasing agent contains a hydrocarbon component which includes a linear hydrocarbon component and a branched hydrocarbon component, in which an amount of the linear hydrocarbon component in the releasing agent is 70% by mass or more based on the total mass of the hydrocarbon component of the releasing agent, the branched hydrocarbon component has a carbon number distribution, an amount of a component of the branched hydrocarbon component having a carbon number of 40 or less in the releasing agent is 2% by mass or less based on the total mass of the hydrocarbon component of the releasing agent, and the releasing agent has an endothermic curve measured with a DSC, in which a ratio (b/a×100) is 2.5 or less, wherein a (J/g) represents an endothermic amount per unit amount at 50° C. or lower, and b (J/g) represents a total endothermic amount per unit amount.

The preferred range for the carbon number of the branched hydrocarbon component is the same as in the toner for developing an electrostatic latent image according to the second aspect of the invention.

The ratio (b/a×100), wherein a (J/g) represents an endothermic amount per unit amount at 50° C. or lower, and b (J/g) represents a total endothermic amount per unit amount, is 2.5 or less, preferably from 0.1 to 2.5, and more preferably from 0.1 to 2.0. In the case where the ratio (b/a×100) exceeds 2.5, the proportion of the low melting point component in the toner is increased to lower the glass transition temperature Tg of the toner significantly, whereby the storage stability and the flowability of the toner are deteriorated, and the durability of an image obtained is also deteriorated.

The measurement of the endothermic curve can be effected by using a differential scanning calorimeter, DSC-7, produced by Perkin-Elmer, Inc. The temperature compensation of the detector of the apparatus is effected by utilizing the melting points of indium and zinc, and the compensation of the amount of heat is effected by using the melting heat amount of indium. The sample to be measured is placed on an aluminum pan and measured at a temperature increasing rate of 10° C. per min with a blank pan for reference.

The toner for developing an electrostatic latent image according to the first to third aspect of the invention will be described in detail below.

The releasing agent used in the invention contains a hydrocarbon component, and the hydrocarbon component contains a linear hydrocarbon component and, as an arbitrary component, a branched hydrocarbon component. The proportion of the branched hydrocarbon component in the releasing agent is preferably from 4 to 30% by mass. In the case where the proportion of the branched hydrocarbon component is 4% by mass or more, it is preferred since the amount of heat upon melting the releasing agent is small. In the case where the proportion of the branched hydrocarbon component is 30% by mass or less, it is preferred since good compatibility is obtained with the binder resin of the toner to facilitate exuding of the releasing agent upon fixing. Accordingly, in the case where the proportion of the branched hydrocarbon component in the releasing agent is from 4 to 30% by mass, it is preferred since fixing can be effected with low energy.

Specific examples of a substance used as the releasing agent include low molecular weight polyolefin wax, such as polyethylene, polypropylene and polybutene, vegetable wax, such as carnauba wax, rice wax, candelilla wax, haze wax and jojoba oil, animal wax, such as bees wax, mineral or petroleum wax, such as montan wax, ozokerite, ceresin, paraffin wax, microcrystalline wax and Fischer-Tropsch wax, and modified products thereof.

Preferred examples thereof include paraffin wax, microcrystalline wax, and polyolefin wax, such as polyethylene, and paraffin wax and polyethylene wax can be particularly preferably used.

A releasing agent having a small acid value and a hydroxyl group value, such as paraffin wax and polyethylene wax, is preferred owing to the smaller influence on charge of the toner, and is also preferred owing to the small polarity since the low compatibility with the binder resin of the toner facilitates exuding of the releasing agent upon fixing.

Such wax is also preferred that is sharpened in carbon number distribution through molecular distillation or crystallization from a solvent. The purified wax through molecular distillation or crystallization from a solvent is preferred since the proportion of the linear hydrocarbon component is increased. The purified wax is advantageous for fixing because of the narrow molecular weight distribution and the small difference between the endothermic peak and exothermic peak, and exerts less adverse influence on the glass transition temperature Tg of the toner owing to the small proportion of a low molecular weight component therein.

The releasing agent used in the invention preferably has a melt viscosity at 120° C. of from 1 to 9 mPa·s, more preferably from 4 to 9 mPa·s, and particularly preferably from 4 to 8 mPa·s.

The viscosity of the releasing agent at 120° C. is measured with an E-type viscometer. Upon measuring, an E-type viscometer, produced by Tokyo Keiki Co., Ltd. having an oil circulating thermostatic bath and a cone plate equipped therewith. The cone plate has a cone angle of 1.34°. The temperature of the circulating thermostatic bath is set at 120° C. A blank measuring cup and a cone are set in the measuring apparatus, and the temperature of the measuring apparatus is stabilized by circulating an oil. After stabilizing the temperature, 1 g of the sample is placed in the measuring cup, and the cone is allowed to stand still for 10 minutes. After stabilizing the cone, the cone is rotated to effect measurement. The rotation speed of the cone is 60 rpm. The measurement is repeated three times, and the average value is designated as the viscosity.

The releasing agent is dispersed in water along with an ionic surfactant and a polymer electrolyte, such as a polymer acid and a polymer base, and applied with a strong shearing force by using a homogenizer or a pressure discharge dispersing machine under heating to a temperature higher than the melting point thereof, so as to disperse the releasing agent to particles, whereby a dispersion liquid of the releasing agent having a diameter of 1 μm or less can be produced. The particle diameter of the releasing agent particles in the dispersion liquid can be measured by using a laser diffraction particle diameter distribution measuring apparatus, LA-700, produced by Horiba, Ltd.

The resin that can be used as the binder resin and the polymer used in the resin particles in the invention can be selected from wide variety of materials and are not particularly limited, and a homopolymer or a copolymer of an ethylenic unsaturated monomer including a vinyl monomer is preferably used. Examples of the monomer constituting the homopolymer or the copolymer include a styrene compound, such as styrene, p-chlorostyrene and α-methylstyrene; a (meth)acrylate ester compound, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; an ethylenic unsaturated nitrile compound, such as acrylonitrile and methacrylonotrile; an ethylenic unsaturated carboxylic acid, such as acrylic acid, methacrylic acid and crotonic acid; a vinyl ether compound, such as vinyl methyl ether and vinyl isobutyl ether; a vinyl ketone compound, such as vinyl methyl ketone, vinyl ethyl ketone and vinyl isopropenyl ketone; an olefin compound, such as ethylene, propylene and butadiene; and β-carboxyethyl acrylate. The homopolymer obtained by polymerizing the monomer, the copolymer obtained by copolymerizing two or more kinds of the monomers, and a mixture thereof can be used. Examples of the resin and the polymer also include a non-vinyl condensation resin, such as an epoxy resin, a polyester resin, a polyurethane resin, a polyamide resin, a cellulose resin and a polyether resin, a mixture of the non-vinyl condensation resin and the polymer of the ethylenic unsaturated monomer, and a graft polymer obtained by polymerizing the ethylenic unsaturated monomer in the presence of the non-vinyl condensation resin.

Examples of a polymerization initiator used upon polymerization include any appropriate polymerization initiator including an azo or diazo polymerization initiator, such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile, a peroxide polymerization initiator, such as benzoyl peroxide, methyl ethyl ketone peroxide, diisopropyl peroxycarbonate, cumene hydroperoxide, 2,4-dichlorobenzoyl peroxide and lauroyl peroxide, a thiol compound, such as dodecanethiol, and ammonium peroxo disulfate.

In the case where an ethylenic unsaturated monomer is polymerized, emulsion polymerization may be effected by using an ionic surfactant to produce a resin particle dispersion liquid. In the case of an oily resin that can be dissolved in a solvent having a relatively low solubility in water, the resin is dissolved in the solvent and dispersed in water along with an ionic surfactant and a polymer electrolyte by using a dispersing machine, such as a homogenizer, to particles, from which the solvent is then evaporated by heating or reducing pressure, whereby a resin particle dispersion liquid can be obtained. The particle diameter of the resin particles in the dispersion liquid can be measured, for example, by using a laser diffraction particle diameter distribution measuring apparatus, LA-700, produced by Horiba, Ltd.

The resin and the resin particles used as the binder resin in the invention are not particularly limited, and in general, a resin particle dispersion liquid containing an ionic surfactant is prepared by emulsion polymerization and is used in the invention. The resin particle dispersion liquid is mixed with a colorant particle dispersion liquid and the releasing agent dispersion liquid, and hetero aggregation of these particles is effected by adding such an ionic surfactant that has a polarity opposite to that contained in the resin particle dispersion liquid, so as to form aggregated particles having the toner diameter. Thereafter, the aggregated particles are heated to a temperature higher than the glass transition temperature of the resin particles to fuse and integrate the aggregated particles, which are then washed and dried to obtain a toner. The toner may preferably have any shape including from an irregular shape to a spherical shape.

The toner may also be preferably obtained in the following manner. In the initial step of mixing the resin particle dispersion, the colorant particle dispersion and the releasing agent dispersion, the balance among the amounts of the ionic dispersants of the respective polarities is deviated, and is then ionically neutralized by adding a polymer of an inorganic metallic salt, such as polyaluminum chloride, to form stabilized mother aggregated particles of the first stage at a temperature lower than the glass transition temperature of the resin. As the second stage, a resin particle dispersion treated with an ionic dispersant with such a polarity and an amount that compensate the ionic deviation is then added thereto, and depending on necessity, the mixture is slightly heated to a temperature lower than the glass transition temperatures of the resins contained the resin particles in the aggregated particles and the additional resin particles to stabilize at a higher temperature. The mixture is then heated to a temperature higher than the glass transition temperature to integrate the mother particles having the particles attached to the surface thereof in the second stage. The stepwise aggregation operation may be repeated in plural times. The stepwise aggregation operation is effective for improving encompassment of the releasing agent and the colorant.

The toner of the invention may also preferably obtained by dispersing the resin, the colorant and the releasing agent in water with a surfactant; aggregating the dispersed components with a metallic ion; and thermally fusing the aggregated components. It is also preferred that the thermally fusing step is effected at a temperature equal to or higher than a melting point of the releasing agent. In the case where the thermally fusing step is effected at such a temperature, the releasing agent is sufficiently melted in the toner and easily exuded upon fixing to provide good releasing capability. The temperature descending rate after completing the thermally fusing step is preferably from 0.4 to 3° C. per minute, and more preferably from 1 to 3° C. per minute. In the case where the temperature descending rate is in the range, the releasing agent has low compatibility with the binder resin in the toner, whereby the toner can be produced without increase of the glass transition temperature Tg. It is also preferred that the thermally fusing step is effected at a temperature equal to or higher than the melting point of the releasing agent. In the case where the thermally fusing step is effected at a temperature equal to or higher than the melting point of the releasing agent, the size of domains of the releasing agent in the toner is increased to facilitate exuding upon fixing.

The releasing agent in the invention is preferably contained in the toner for developing an electrostatic latent image in an amount of from 5 to 15% by mass based on the solid content of the toner. In the case where the amount of the releasing agent is in the range, it is preferred since the fixing capability on oilless fixing is improved. The amount of the releasing agent is more preferably from 6 to 11% by mass based on the solid content of the toner.

The acid value of the toner in the invention is important for not only improving the encompassment and the stability of the releasing agent particles and the colorant particles in the toner, but also improving the charging property, and is preferably from 10 to 50 mgKOH/g. In the case where the acid value is in the range, the encompassment and the stability of the releasing agent particles and the colorant particles are improved, and suitable charging property can be obtained. Furthermore, the amount of component for imparting the acid value is appropriate to prevent crosslinking, and thus good fixing property can be obtained.

The toner of the invention preferably has a volume average particle diameter D50v of the toner particles of from 3 to 9 μm, a volume average particle diameter distribution index GSDv $(D84v/D16v)^{0.5}$ of 1.30 or less, and a ratio (GSDv/GSDp) of the volume average particle diameter distribution index GSDv and the number average particle diameter distribution index GSDp of 0.95 or more. In the case where the parameter is in the ranges, such a toner for developing an electrostatic latent image can be provided that can form an image excellent in fine reproducibility. More preferably, D50v is from 4 to 8 μm, GSDv is from 1.0 to 1.28, and GSDv/GSDp is from 0.05 to 1.2. In the case where the toner of the invention has a volume average particle diameter D50v in the range, the toner has appropriate charging property to obtain good developing property, which can provide a high resolution. In the case where the volume average particle diameter distribution index is in the range, a high resolution can be obtained. In the case where the ratio (GSDv/GSDp) of the volume average particle diameter distribution index and the number average particle diameter distribution index is in the range, good charging property can be obtained, and image defects, such as scattering of the toner and fogging, can be prevented from occurring.

The volume average particle diameter, the volume average particle diameter distribution index and the number average particle diameter distribution index in the invention can be measured, for example, by using a particle size distribution measurement device, such as Coulter Counter TA-II and Coulter Multisizer II, both produced by Beckman Coulter, Inc. The particle diameter distribution is calculated in the following manner. Cumulative distributions by volume and number are drawn from the smaller diameter side for the respective particle diameter ranges (channels) divided. The particle diameters with a cumulative amount of 16% are designated as a volume average particle diameter D16v and the number average particle diameter D16p, and the particle diameters with a cumulative amount of 84% are designated as a volume average particle diameter D84v and the number average particle diameter D84p. By using these values, the volume average particle diameter distribution index GSDv is calculated from D84v/D16v, and the number average particle diameter distribution index GSDp is calculated from D84p/D16p.

The toner of the invention preferably has a shape factor SF1 of from 110 to 140 since such a toner for developing an electrostatic latent image can be obtained that is excellent in developing property and transferring property. The shape factor SF1 of the toner is more preferably from 125 to 138. The shape factor SF1 is an average value of the shape coefficient and can be calculated in the following manner. An optical micrograph of the toner scattered on slide glass is loaded to a Luzex image analyzer through a video camera. The shape factor SF1 is obtained for 50 toner particles from the maximum length and the projected area thereof according to the following equation, and the average value thereof is obtained.

$$SF1=(ML)^2/A\times(100/4\pi)$$

wherein ML represents the maximum length of the toner particle, and A represents the projected area of the toner particle.

The toner for developing an electrostatic latent image of the invention preferably has a charge amount of from 20 to 80 μC/g, and more preferably from 25 to 35 μC/g. In the case where the charge amount is in the range, it is preferred since background stain (fogging) is difficult to occur, and a good image density can be obtained.

The toner for developing an electrostatic latent image preferably has a ratio of the charge amount in summer season (high temperature and humidity) to the charging amount in winter season (low temperature and humidity) of from 0.5 to 1.5, and more preferably from 0.7 to 1.3. In the case where the ratio is in the range, it is preferred since the charge property is low in environmental dependency, and good stability in charging can be obtained.

The toner of the invention preferably has a glass transition temperature Tg of from 49 to 58° C., and more preferably from 50 to 54° C. In the case where the glass transition temperature is in the range, it is preferred since the storage stability of the toner is improved, and the durability, such as document offset, and the folding resistance of an image are improved.

The colorant used in the invention may be any material having been known in the art. Examples of a black pigment include carbon black, copper oxide, manganese dioxide, aniline black, activated carbon, non-magnetic ferrite and magnetite. Examples of a yellow pigment include chrome yellow, zinc chromate, yellow iron oxide, Cadmium Yellow, Chrome Yellow, Hansa Yellow, Hansa Yellow 10G, Benzidine Yellow G, Benzidine Yellow GR, Threne Yellow, Quinoline Yellow and Permanent Yellow NCG.

Examples of an orange pigment include red chrome yellow, Molybdenum Orange, Permanent Orange GTR, Pyrazolone Orange, Vulkan Orange, Benzidine Orange G, Indanthrene Brilliant Orange RK and Indanthrene Brilliant Orange GK. Examples of a red pigment include red iron oxide, cadmium red, lead red, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosin Red and Alizarin Lake.

Examples of a blue pigment include iron blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate. Examples of a violet pigment include manganese violet, Fast Violet B and Methyl Violet Lake.

Examples of a green pigment include chromium oxide, Chrome Green, Pigment Green, Malachite Green Lake and Final Yellow Green G. Examples of a white pigment include zinc white, titanium oxide, antimony white and zinc sulfide. Examples of a body pigment include barytes, barium carbonate, clay, silica, white carbon, talc and alumina white. Examples of a dye include various kinds of dyes, such as basic, acidic, dispersion and direct dyes, e.g., nigrosine, Methylene Blue, Rose Bengal, Quinoline Yellow and Ultramarine Blue.

The colorants may be used solely, as a mixture or as a sold solution. The colorant is dispersed in the known method, and for example, a rotation shearing homogenizer, a media dispersing machine, such as a ball mill, a sand mill and an attritor, and a high-pressure counter collision dispersing machine are preferably used.

The colorant particles are dispersed in an aqueous system by using a surfactant having polarity with the aforementioned homogenizer.

The colorant in the invention is selected from the standpoint of hue angle, chroma saturation, brightness, weather resistance, OHP transparency, and dispersibility in the toner. The addition amount of the colorant is preferably from 1 to 20 parts by mass per 100 parts by mass of the resin contained in the toner. In the case where a magnetic material is used as a black colorant, the colorant is preferably added in an amount of from 30 to 100 parts by mass per 100 parts by mass of the resin, as different from the cases of the other colorants.

In the case where the toner of the invention is used as a magnetic toner, magnetic powder may be contained in the binder resin. A substance that is magnetized in a magnetic field is used as the magnetic powder. Specific examples thereof include ferromagnetic powder, such as iron, cobalt and nickel, and a compound, such as ferrite and magnetite. In order to obtain the toner in an aqueous phase, particularly in the invention, the aqueous phase transferring property of the magnetic material is important. It is preferred that the magnetic material is subjected to a surface modification treatment, such as a hydrophobic treatment.

In the invention, a charge controlling agent may be added to the toner for further improving and stabilizing the charging property of the toner. Examples of the charge controlling agent include a quaternary ammonium salt compound, a nigrosine compound, a dye containing a complex of aluminum, iron or chromium, and a triphenylmethane pigment. A material that is difficultly dissolved in water is preferred for controlling the ion strength, which influences the stability upon aggregation or fusion and integration, and for reducing contamination of the waste water.

Inorganic particles may be added to the toner by a wet method for stabilizing the charging property of the toner. As examples of the inorganic particles, any material that is generally used as an external additive for the toner surface, such as silica, alumina, titania, calcium carbonate, magnesium carbonate and tricalcium phosphate, may be used after dispersing in an ionic surfactant, a polymer acid or a polymer base.

In order to impart flowability or to improve the cleaning property, inorganic particles, such as silica, alumina, titania and calcium carbonate, or resin particles, such as a vinyl resin, polyester and silicone, may be added after drying the toner to the toner surface by applying a shearing force in a dry state, so as to use as a flowability assistant or a cleaning assistant.

Examples of the surfactant used in emulsion polymerization of the resin particles, dispersion of the colorant, addition and dispersion of the resin particles, dispersion of the releasing agent, and aggregation and stabilization of these components, in the production process for the toner of the invention include an anionic surfactant, such as a sulfate ester compound, a sulfonate salt compound, a phosphate ester compound and a soap compound, and a cationic surfactant, such as an amine salt compound and a quaternary ammonium salt compound. It is effective to use, in combination, a nonionic surfactant, such as a polyethylene glycol compound, an alkylphenol ethylene oxide adduct and a polyhydric alcohol. The dispersing method therefor may be those generally employed, such as a rotation shearing homogenizer and a media dispersing machine, such as ball mill, a sand mill and a Dinor mill.

In the invention, the target toner can be obtained through arbitrary washing, solid-liquid separation and drying steps after completing the fusing and integrating step. The washing step is preferably effected sufficiently by substitution washing with ion exchanged water for exerting and maintaining the charging property. The solid-liquid separation step is not particularly limited, and suction filtration and pressure filtration are preferably used from the standpoint of productivity. The drying step is also not particularly limited, and freeze drying, flash-jet drying, fluidized drying and vibrating fluidized drying are preferably used from the standpoint of productivity.

The toner of the invention may be used as a one-component developer as it is, or may be used as a two-component developer, for developing an electrostatic latent image. In the case where the toner is used as a two-component developer, the toner is mixed with a carrier.

The carrier that can be used in the two-component developer is not particularly limited, and the known carriers may be used. Examples thereof include iron oxide, a magnetic metal, such as nickel and cobalt, a magnetic oxide, such as ferrite and magnetite, a resin coated carrier having these core materials having on the surface thereof a resin coated layer, and a magnetic dispersion carrier. A resin dispersion carrier containing a matrix resin having a conductive material or the like dispersed therein may also be used.

Examples of the coated resin and the matrix resin used in the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a linear silicone resin containing an organosiloxane bond and a modified product thereof, a fluorine resin, polyester, polycarbonate, a phenol resin and an epoxy resin, but the invention is not limited to them.

Examples of the conductive material include a metal, such as gold, silver and copper, carbon black, titanium oxide, zinc oxide, barium sulfate, aluminum borate, potassium titanate, and tin oxide, but the invention is not limited to them.

Examples of the core material of the carrier include a magnetic metal, such as iron, nickel and cobalt, a magnetic compound, such as ferrite and magnetite, and glass beads, and a magnetic material is preferably used for applying the carrier to a magnetic brush method. The core material of the carrier generally has a volume average particle diameter of from 10 to 50 μm, and preferably from 30 to 100 μm.

Upon coating a resin on the surface of the core material of the carrier, for example, a solution for forming a coated layer is formed by dissolving the coating resin and, depending on necessity, various kinds of additives in a suitable solvent, and the solution is coated on the core material. The solvent is not particularly limited, and can be appropriately selected under consideration of the coating resin used and the coating suitability.

Specific examples of the resin coating method include the dipping method of dipping the core material of the carrier in the solution for forming a coated layer, the spraying method of spraying the solution for forming a coated layer onto the surface of the core material of the carrier, the fluidized bed method of spraying the solution for forming a coated layer onto the core material of the carrier in a floating state with a fluidizing air stream, and the kneader-coater method of mixing the core material of the carrier and the solution for forming a coated layer in a kneader-coater, followed by removing the solvent.

The mixing ratio (weight ratio) of the toner of the invention and the carrier in the two-component developer (toner/carrier) is generally about from 1/100 to 30/100, and preferably about from 3/100 to 20/100.

EXAMPLE

The invention will be further described in more detail with reference to the following examples, but the invention is not construed as being limited thereto.

The toner of the invention is produced in the following manner. A resin particle dispersion liquid, a colorant particle dispersion liquid and a releasing agent particle dispersion liquid are prepared respectively, and the prescribed amounts of the dispersion liquids are mixed, to which a polymer of an inorganic metallic chloride is added to neutralize ionically, whereby aggregated bodies of the aforementioned kinds of particles are produced. The pH of the system is adjusted to a range of from weak acidity to neutral with an inorganic hydroxide, and the system is heated to a temperature higher than the glass transition temperature of the resin particles to fuse and integrate the aggregated bodies. Thereafter, a target toner is obtained through sufficient washing, solid-liquid separation and drying steps. Specific examples of the preparation methods of the materials and the formation method of the aggregated particles will be described below.

Example 1

| (Preparation of Resin Particle Dispersion Liquid 1) | |
|---|---|
| (Oily Phase) | |
| Styrene (produced by Wako Pure Chemical Industries, Ltd.) | 30 parts by weight |
| n-Butyl acrylate (produced by Wako Pure Chemical Industries, Ltd.) | 10 parts by weight |
| β-Carboxyethyl acrylate (produced by Rhodia Nicca, Ltd.) | 1.3 parts by weight |
| Dodecanethiol (produced by Wako Pure Chemical Industries, Ltd.) | 0.4 part by weight |
| (Aqueous Phase 1) | |
| Ion exchanged water | 17 parts by weight |
| Anionic surfactant (Neogen SC, produced by Dai-ichi Kogyo Seiyaku Co., Ltd.) | 0.3 part by weight |
| (Aqueous Phase 2) | |
| Ion exchanged water | 40 parts by weight |
| Anionic surfactant (Neogen SC, produced by Dai-ichi Kogyo Seiyaku Co., Ltd.) | 0.04 part by weight |
| Ammonium peroxo disulfate (produced by Wako Pure Chemical Industries, Ltd.) | 0.4 part by weight |

The components of the oily phase and the components of the aqueous phase 1 are mixed and stirred in a flask to obtain a monomer emulsion dispersion liquid. The components of the aqueous phase 2 are placed in a reaction vessel, and after sufficiently replacing the interior of the vessel with nitrogen, the reaction system is heated over an oil bath to 75° C. under stirring. The monomer emulsion dispersion liquid is gradually added dropwise to the reaction vessel over 3 hours to effect emulsion polymerization. After completing the dropwise addition, the polymerization is continued at 75° C. and then terminated after lapsing 3 hours.

The resulting resin particles have a volume average particle diameter D50v of 230 nm as measured with a laser diffraction particle diameter distribution measuring apparatus, LA-700, produced by Horiba, Ltd., a glass transition temperature of 51° C. as measured with a differential scanning calorimeter, DSC-50, produced by Shimadzu Corp. at a temperature increasing rate of 10° C. per minutes, a number average molecular weight (polystyrene conversion) of 13,000 as measured with a molecular weight measuring apparatus, HLC-8020, produced by Tosoh Corp. using THF as a solvent, and a melt viscosity of 17 mPa·s as measured at 180° C. with an E-type viscometer, produced by Tokyo Keiki Co., Ltd., having a cone angle of 1.34° at 60 rpm.

Accordingly, a resin particle dispersion liquid 1 having a volume average particle diameter of 230 nm, a solid content of 42%, a glass transition temperature of 51° C. and a number average molecular weight Mn of 13,000 is obtained.

(Preparation of Colorant Particle Dispersion Liquid)

| (Preparation of Colorant Particle Dispersion Liquid) | |
|---|---|
| Black pigment (carban black, Regal 330 produced by Cabot Oil & Gas Corp.) | 30 parts by weight |

-continued

| (Preparation of Colorant Particle Dispersion Liquid) | |
|---|---|
| Anionic surfactant (Neogen SC, produced by Dai-ichi Kogyo Seiyaku Co., Ltd.) | 2.5 parts by weight |
| Ion exchanged water | 400 parts by weight |

The aforementioned components are mixed and dispersed with a homogenizer (Ultra Turrax, produced by IKA Works Inc.) for 10 minutes to obtain a colorant particle dispersion liquid having a volume average particle diameter of 120 nm and a solid content of 20%.

(Preparation of Releasing Agent)

(Releasing Agent 1-1)

Fischer-Tropsch wax having a melting point of 89° C. derived from natural gas is prepared and repeatedly subjected to molecular distillation until the proportion of the linear hydrocarbon component having a carbon number of from N−4 to N+4 becomes 80% by mass or more of the total hydrocarbon component, and the proportion of the linear hydrocarbon component having a carbon number of N−10 or less or N+10 or more becomes 0.05% by mass or less of the total hydrocarbon component, wherein N represents the average carbon number of the linear hydrocarbon component. The molecular distillation is repeatedly effected at a temperature of 400° C. and a pressure of $10^{-3}$ Torr after removing low molecular weight components at a temperature of 240° C. and a pressure of $10^{-3}$ Torr.

As a result, a releasing agent having an average carbon number N of 46, a proportion of the linear hydrocarbon component having a carbon number of from N−4 to N+4 of 85% by mass, and a proportion of the linear hydrocarbon component having a carbon number of N−10 or less or N+10 or more of 0% is obtained.

(Releasing Agent 1-2)

Polyethylene wax having a melting point of 90° C. and having no branched chain is prepared and repeatedly subjected to molecular distillation until the proportion of the linear hydrocarbon component having a carbon number of from N−4 to N+4 becomes 80% by mass or more of the total hydrocarbon component, and the proportion of the linear hydrocarbon component having a carbon number of N−10 or less or N+10 or more becomes 0.05% by mass or less of the total hydrocarbon component, wherein N represents the average carbon number of the linear hydrocarbon component. The molecular distillation is repeatedly effected at a temperature of 400° C. and a pressure of $10^{-3}$ Torr after removing low molecular weight components at a temperature of 240° C. and a pressure of $10^{-3}$ Torr.

As a result, a releasing agent having an average carbon number N of 48, a proportion of the linear hydrocarbon component having a carbon number of from N−4 to N+4 of 80% by mass, and a proportion of the linear hydrocarbon component having a carbon number of N−10 or less or N+10 or more of 0% is obtained.

(Releasing Agent 1-3)

Microcrystalline wax having a melting point of 84° C. is obtained through crystallization from a solvent and filtration from a residual oil of distillation under reduced pressure and repeatedly subjected to solvent extraction until the proportion of the linear hydrocarbon component having a carbon number of from N−4 to N+4 becomes 80% by mass or more of the total hydrocarbon component, and the proportion of the linear hydrocarbon component having a carbon number of N−10 or less or N+10 or more becomes 0.05% by mass or less of the total hydrocarbon component, wherein N represents the average carbon number of the linear hydrocarbon component. The purification by solvent extraction is carried out by dissolving the wax in a mixed solvent of MEK and toluene under heating and crystallizing by cooling, followed by filtering.

As a result, a releasing agent having an average carbon number N of 49, a proportion of the linear hydrocarbon component having a carbon number of from N−4 to N+4 of 86% by mass, and a proportion of the linear hydrocarbon component having a carbon number of N−10 or less or N+10 or more of 0% is obtained.

(Releasing Agent 1-4)

Paraffin wax having a proportion of the linear hydrocarbon component having a carbon number of from N−4 to N+4 of 70% by mass or less, wherein N represents the average carbon number of the linear hydrocarbon component. The paraffin wax is obtained by subjecting Fischer-Tropsch wax to molecular distillation and has an average carbon number N of 41, a proportion of the linear hydrocarbon component having a carbon number of from N−4 to N+4 of 40% by mass, a proportion of the linear hydrocarbon component having a carbon number of N−10 or less of 9% by mass, and a proportion of the linear hydrocarbon component having a carbon number of N+10 or more of 12% by mass.

(Releasing Agent 1-5)

Paraffin wax having a proportion of the linear hydrocarbon component having a carbon number of from N−4 to N+4 of 70% by mass or less, wherein N represents the average carbon number of the linear hydrocarbon component. The paraffin wax is obtained by subjecting a residual oil of distillation under reduced pressure to crystallization from a solvent and filtration and has an average carbon number N of 38, a proportion of the linear hydrocarbon component having a carbon number of from N−4 to N+4 of 70% by mass, a proportion of the linear hydrocarbon component having a carbon number of N−10 or less of 0.1% by mass, and a proportion of the linear hydrocarbon component having a carbon number of N+10 or more of 1.0% by mass.

(Preparation of Releasing Agent Particle dispersion Liquid 1-1)

| (Preparation of Releasing Agent Particle Dispersion Liquid 1-1) | |
|---|---|
| Releasing agent 1-1 | 50 parts by weight |
| Anionic surfactant (Neogen SC, produced by Dai-ichi Kogyo Seiyaku Co., Ltd.) | 2 parts by weight |
| Ion exchanged water | 200 parts by weight |

The aforementioned components heated to 120° C. are sufficiently dispersed with Ultra Turrax T-50, produced by IKA Works Inc., and then further dispersed with a pressure discharge homogenizer at a temperature of 110° C. and a pressure of 500 kg/cm$^2$ for 60 minutes, so as to obtain a releasing agent particle dispersion liquid having a volume average particle diameter of 240 nm and a solid content of 20%.

(Preparation of Releasing Agent Particle Dispersion Liquids 1-2 to 1-5)

Releasing agent particle dispersion liquids 1-2 to 1-5 are obtained in the same manner as in the preparation of the releasing agent dispersion liquid 1-1 except that the releasing agents 1-2 to 1-5, respectively, instead of the releasing agent 1-1. The releasing agent particle dispersion liquids 1-2 to 1-5 have a solid content of 20% and the following volume average particle diameters.

Releasing agent particle dispersion liquid 1-2 240 nm
Releasing agent particle dispersion liquid 1-3 250 nm
Releasing agent particle dispersion liquid 1-4 230 nm
Releasing agent particle dispersion liquid 1-5 230 nm The carbon number distributions, the average carbon numbers, the proportions of the linear hydrocarbon components, the melting points and the species of the materials of the releasing agents of the releasing agents 1-1 to 1-5 are shown in Table 1 below.

TABLE 1

| Releasing agent | Material | Proportion of N − 4 to N + 4 (% by mass) | Proportion of N − 10 (% by mass) | Proportion of N + 10 (% by mass) | Average carbon number | Proportion of linear hydrocarbon component (% by mass) | Melting point (° C.) |
|---|---|---|---|---|---|---|---|
| 1-1 | paraffin wax | 85 | 0 | 0 | 46 | 97 | 92 |
| 1-2 | polyethylene wax | 80 | 0 | 0 | 48 | 100 | 94 |
| 1-3 | micro-crystalline wax | 86 | 0 | 0 | 49 | 88 | 100 |
| 1-4 | paraffin wax | 40 | 9 | 12 | 41 | 90 | 86 |
| 1-5 | paraffin wax | 70 | 0.1 | 1 | 38 | 87 | 76 |

Example 1-1

| | |
|---|---|
| Resin particle dispersion liquid 1 | 150 parts by weight |
| Colorant particle dispersion liquid | 30 parts by weight |
| Releasing agent particle dispersion liquid 1-1 | 40 parts by weight |
| Polyaluminum chloride | 0.4 part by weight |

The aforementioned components are sufficiently mixed and dispersed in a round-bottom stainless steel flask with Ultra Turrax T-50, produced by IKA Works Inc., and then heated to 50° C. over an oil bath for heating while stirring the content of the flask. After retaining at 50° C. for 70 minutes, 70 parts by weight of the same resin particle dispersion liquid is gradually added thereto.

Thereafter, the pH of the system is adjusted to 6.0 with a sodium hydroxide aqueous solution having a concentration of 0.5 mole/L, and then after sealing the stainless steel flask, the system is heated to 96° C. and maintained for 3 hours under continuous stirring using a stirring axis sealed with a magnetic seal. After completing the reaction, the system is cooled at a temperature descending rate of 1° C. per minute, filtered, sufficiently washed with ion exchanged water, and then subjected to solid-liquid separation by Nutsche suction filtration. The resulting product is again dispersed by using 3 L of ion exchanged water at 40° C. and stirred and washed at 300 rpm for 15 minutes. The washing operation is repeated 5 times, and at the time when the filtrate has pH of 6.54 and an electric conductivity of 6.5 μS/cm, the product is subjected to solid-liquid separation by Nutsche suction filtration using No. 5A filter paper. The product is then vacuum-dried for 12 hours to obtain a toner 1-1.

The toner 1-1 has a volume average particle diameter D50v of 6.4 μm and a volume average particle diameter distribution index GSDv of 1.20, as measured with a particle size distribution measurement device, and has a shape factor SF1 of 134, which indicates a potato shape, as observed with a Luzex image analyzer, produced by Nireco Corp. The toner has a glass transition temperature of 51° C. Silica ($SiO_2$) particles having a volume average particle diameter of 40 nm and having been subjected to a surface hydrophobic treatment with hexamethyldisilazane (hereinafter, sometimes abbreviated as HMDS) and metatitanate compound particles having a volume average particle diameter of 20 nm as a reaction product of metatitanic acid and isobutyltrimethoxysilane are added to the toner in such an amount that the coverages of the these kinds of particles are 40%, respectively, on the surface of the toner particles, and then mixed with a Henschel mixer to obtain an electrophotographic toner.

(Test for Fixing Capability)

A test for fixing capability of the toner thus produced is carried out in the following manner.

An image is formed by using a modified machine of DocuColor 1250 with a toner coverage adjusted to 6 g/m$^2$, and fixed by using an external fixing device having no oil feeding device at a nip width of 6.5 mm and a fixing speed of 460 mm/sec. The fixing temperature is controlled by the surface temperature of the fixing roll and set at 200° C.

(Results of Fixing Test)

It is confirmed that the toner exhibits good releasing property in the fixing device, i.e., the image is easily released without resistance, and no offset occurs. Upon folding and unfolding the fixed image, no image defect is observed to provide good results.

Example 1-2

A toner 1-2 is obtained in the same manner as in Example 1-1 except that the same amount of the releasing agent particle dispersion liquid 1-2 is used instead of the releasing agent particle dispersion liquid 1-1.

The toner 1-2 has a volume average particle diameter D50v of 6.4 μm and a volume average particle diameter distribution index GSDv of 1.21, as measured with a particle size distribution measurement device. The toner has a glass transition temperature of 51° C. The toner has a shape factor SF1 of 135, which indicates a potato shape, as observed with a Luzex image analyzer, produced by Nireco Corp.

(Results of Fixing Test)

It is confirmed that the toner exhibits good releasing property in the fixing device, i.e., the image is easily released without resistance, and no offset occurs. Upon folding and unfolding the fixed image, no image defect is observed to provide good results.

Example 1-3

A toner 1-3 is obtained in the same manner as in Example 1-1 except that the same amount of the releasing agent particle dispersion liquid 1-3 is used instead of the releasing agent particle dispersion liquid 1-1.

The toner 1-3 has a volume average particle diameter D50v of 6.3 μm and a volume average particle diameter distribution index GSDv of 1.20, as measured with a particle size distribution measurement device. The toner has a glass transition temperature of 50° C. The toner has a shape factor SF1 of 132, which indicates a rounded potato shape, as observed with a Luzex image analyzer, produced by Nireco Corp.

(Results of Fixing Test)

It is confirmed that the toner exhibits good releasing property in the fixing device, i.e., the image is easily released without resistance, and no offset occurs. Upon folding and unfolding the fixed image, no image defect is observed to provide good results.

Comparative Example 1-1

A toner 1-4 is obtained in the same manner as in Example 1-1 except that the same amount of the releasing agent particle dispersion liquid 1-4 is used instead of the releasing agent particle dispersion liquid 1-1.

The toner 1-4 has a volume average particle diameter D50v of 6.3 μm and a volume average particle diameter distribution index GSDv of 1.20, as measured with a particle size distribution measurement device. The toner has a glass transition temperature of 50° C. The toner has a shape factor SF1 of 132, which indicates a rounded potato shape, as observed with a Luzex image analyzer, produced by Nireco Corp.

(Results of Fixing Test)

The toner exhibits poor releasing property in the fixing device, i.e., resistance is observed upon releasing the image, and offset occurs to form a thin impression of the image. Upon folding and unfolding the fixed image, no image defect is observed to provide good results.

Comparative Example 1-2

A toner 1-5 is obtained in the same manner as in Example 1-1 except that the same amount of the releasing agent particle dispersion liquid 1-5 is used instead of the releasing agent particle dispersion liquid 1-1.

The toner 1-5 has a volume average particle diameter D50v of 6.4 μm and a volume average particle diameter distribution index GSDv of 1.20, as measured with a particle size distribution measurement device. The toner has a glass transition temperature of 49° C. The toner has a shape factor SF1 of 132, which indicates a rounded potato shape, as observed with a Luzex image analyzer, produced by Nireco Corp.

(Results of Fixing Test)

The toner exhibits poor releasing property in the fixing device, i.e., resistance is observed upon releasing the image, and offset occurs to form a slight impression of the image, which can be found by careful observation. Upon folding and unfolding the fixed image, no image defect is observed to provide good results.

The results of Examples 1-1 to 1-3 and Comparative Examples 1-1 and 1-2 are shown in Table 2 below. In Table 2 and the following descriptions, the evaluation symbols indicate the grades shown below.

AA: excellent

A: good

B: poor

C: very poor

TABLE 2

| | Releasing agent | Releasing property | Offset | Image defect on folding |
|---|---|---|---|---|
| Example 1-1 | 1-1 | AA | A | A |
| Example 1-2 | 1-2 | A | A | A |
| Example 1-3 | 1-3 | A | A | A |
| Comparative Example 1-1 | 1-4 | B | C | A |
| Comparative Example 1-2 | 1-5 | B | B | A |

Example 2

| (Preparation of Resin Particle Dispersion Liquid 2) | |
|---|---|
| (Oily Phase) | |
| Styrene (produced by Wako Pure Chemical Industries, Ltd.) | 30 parts by weight |
| n-Butyl acrylate (produced by Wako Pure Chemical Industries, Ltd.) | 10 parts by weight |
| β-Carboxyethyl acrylate (produced by Rhodia Nicca, Ltd.) | 1.3 parts by weight |
| Dodecanethiol (produced by Wako Pure Chemical Industries, Ltd.) | 0.4 part by weight |
| (Aqueous Phase 1) | |
| Ion exchanged water | 17 parts by weight |
| Anionic surfactant (Neogen SC, produced by Dai-ichi Kogyo Seiyaku Co., Ltd.) | 0.3 part by weight |
| (Aqueous Phase 2) | |
| Ion exchanged water | 40 parts by weight |
| Anionic surfactant (Neogen SC, produced by Dai-ichi Kogyo Seiyaku Co., Ltd.) | 0.04 part by weight |
| Ammonium peroxo disulfate (produced by Wako Pure Chemical Industries, Ltd.) | 0.4 part by weight |

The components of the oily phase and the components of the aqueous phase 1 are mixed and stirred in a flask to obtain a monomer emulsion dispersion liquid. The components of the aqueous phase 2 are placed in a reaction vessel, and after sufficiently replacing the interior of the vessel with nitrogen, the reaction system is heated over an oil bath to 75° C. under stirring. The monomer emulsion dispersion liquid is gradually added dropwise to the reaction vessel over 3 hours to effect emulsion polymerization. After completing the dropwise addition, the polymerization is continued at 75° C. and then terminated after lapsing 3 hours.

The resulting resin particles have a volume average particle diameter D50v of 220 nm as measured with a laser diffraction particle diameter distribution measuring apparatus, LA-700, produced by Horiba, Ltd., a glass transition temperature of 52° C. as measured with a differential scanning calorimeter, DSC-50, produced by Shimadzu Corp. at a temperature increasing rate of 10° C. per minutes, a number average molecular weight (polystyrene conversion) of 13,000 as measured with a molecular weight measuring apparatus, HLC-8020, produced by Tosoh Corp. using THF as a solvent, and a melt viscosity of 17 mPa·s as measured at 180° C. with an E-type viscometer, produced by Tokyo Keiki Co., Ltd., having a cone angle of 1.34° at 60 rpm.

Accordingly, a resin particle dispersion liquid 2 having a volume average particle diameter of 220 nm, a solid content of 42%, a glass transition temperature of 52° C. and a number average molecular weight Mn of 13,000 is obtained.

(Preparation of Colorant Particle Dispersion Liquid)

A colorant particle dispersion liquid is obtained in the same manner as in Example 1.

| (Preparation of Releasing Agent Particle Dispersion Liquid 2-1) | |
|---|---|
| Releasing agent 2-1 | 30 parts by weight |
| Anionic surfactant (Neogen SC, produced by Dai-ichi Kogyo Seiyaku Co., Ltd.) | 1.3 parts by weight |
| Ion exchanged water | 70 parts by weight |

The aforementioned components heated to 120° C. are sufficiently dispersed with a pressure discharge homogenizer to obtain a releasing agent particle dispersion liquid having a volume average particle diameter of 240 nm and a solid content of 30%.

(Preparation of Releasing Agent Particle Dispersion Liquids 2-2 to 2-7)

Releasing agent particle dispersion liquids 2-2 to 2-7 are obtained in the same manner as in the preparation of the releasing agent dispersion liquid 2-1 except that the releasing agents 2-2 to 2-7, respectively, instead of the releasing agent 2-1. The releasing agent particle dispersion liquids 2-2 to 2-7 have a solid content of 30% and the following volume average particle diameters.

Releasing agent particle dispersion liquid 2-2 220 nm

Releasing agent particle dispersion liquid 2-3 220 nm

Releasing agent particle dispersion liquid 2-4 250 nm

Releasing agent particle dispersion liquid 2-5 230 nm

Releasing agent particle dispersion liquid 2-6 220 nm

Releasing agent particle dispersion liquid 2-7 260 nm

The proportion of the component having a carbon number of 40 or less in the branched hydrocarbon component, the melting point, the melting heat amount derived from the releasing agent in the toner, the proportion of the branched hydrocarbon component and the species of the materials of the releasing agents of the releasing agents 2-1 to 2-7 are shown in Table 3 below.

TABLE 3

| Releasing agent | Material | Proportion of component having carbon number of 40 or less (% by mass) | Melting point (° C.) | Melting heat amount (J/g) | Proportion of branched hydrocarbon component (% by mass) | Purification |
|---|---|---|---|---|---|---|
| 2-1 | micro-crystalline wax | 0.9 | 90 | 14.9 | 26.0 | crystallization from solvent |
| 2-2 | paraffin wax | 2.0 | 85 | 15.4 | 4.0 | molecular distillation |
| 2-3 | paraffin wax | 1.9 | 88 | 15.5 | 6.0 | molecular distillation |
| 2-4 | paraffin wax | 1.7 | 91 | 16.7 | 5.4 | molecular distillation |
| 2-5 | micro-crystalline wax | 5.4 | 79 | 15.5 | 38.0 | crystallization from solvent |
| 2-6 | paraffin wax | 8.2 | 65 | 17.1 | 11.6 | crystallization from solvent |
| 2-7 | polyethylene wax | 0.0 | 105 | 19.4 | 0.0 | none |

Example 2-1

| | |
|---|---|
| Resin particle dispersion liquid 2 | 150 parts by weight |
| Colorant particle dispersion liquid | 25 parts by weight |
| Releasing agent particle dispersion liquid 2-1 | 25 parts by weight |
| Polyaluminum chloride | 0.4 part by weight |

The aforementioned components are sufficiently mixed and dispersed in a round-bottom stainless steel flask with Ultra Turrax T-50, produced by IKA Works Inc., and then heated to 50° C. over an oil bath for heating while stirring the content of the flask. After retaining at 50° C. for 80 minutes, 70 parts by weight of the same resin particle dispersion liquid is gradually added thereto.

Thereafter, the pH of the system is adjusted to 6.0 with a sodium hydroxide aqueous solution having a concentration of 0.5 mole/L, and then after sealing the stainless steel flask, the system is heated to 96° C. and maintained for 4 hours under continuous stirring using a stirring axis sealed with a magnetic seal. After completing the reaction, the system is cooled at a temperature descending rate of 1° C. per minute, filtered, sufficiently washed with ion exchanged water, and then subjected to solid-liquid separation by Nutsche suction filtration. The resulting product is again dispersed by using 3 L of ion exchanged water at 40° C. and stirred and washed at 300 rpm for 15 minutes. The washing operation is repeated 5 times, and at the time when the filtrate has pH of from 6.5 to 7.5 and an electric conductivity of 15 μS/cm, the product is subjected to solid-liquid separation by Nutsche suction filtration using No. 5A filter paper. The product is then vacuum-dried for 12 hours to obtain a toner 2-1.

The toner 2-1 has a volume average particle diameter D50v of 6.4 μm and a volume average particle diameter distribution index GSDv of 1.20, as measured with a particle size distribution measurement device, and has a shape factor SF1 of 134, which indicates a potato shape, as observed with a Luzex image analyzer, produced by Nireco Corp. The toner has a glass transition temperature of 51.5° C. Silica ($SiO_2$) particles having a volume average particle diameter of 40 nm and having been subjected to a surface hydrophobic treatment with hexamethyldisilazane (hereinafter, sometimes abbreviated as HMDS) and metatitanate compound particles having a volume average particle diameter of 20 nm as a reaction product of metatitanic acid and isobutyltrimethoxysilane are added to the toner in such an amount that the coverages of the these kinds of particles are 40%, respectively, on the surface of the toner particles, and then mixed with a Henschel mixer to obtain an electrophotographic toner 2-1.

(Test for Fixing Capability)

A test for fixing capability of the toner thus produced is carried out in the following manner.

An image is formed by using a modified machine of DocuColor 1250 with a toner coverage adjusted to 6 g/m$^2$, and fixed by using an external fixing device having no oil feeding device at a nip width of 6.5 mm and a fixing speed of 460 mm/sec. The fixing temperature is controlled by the surface temperature of the fixing roll and set at 200° C.

(Results of Fixing Test)

It is confirmed that the toner exhibits good releasing property in the fixing device, i.e., the image is easily released without resistance, and no offset occurs. The fixed images are superimposed to face each other, on which a load of 50 g/cm$^2$ is applied, and the assembly is allowed to stand in a chamber at a temperature of 50° C. and a humidity of 60% for 7 days to evaluate offset of images. The images can be easily released from each other without resistance to provide good offset property.

(Results of Toner Storage Test)

For evaluating the storage stability of the toner, the toner is evaluated with a powder tester, produced by Hosokawa Micron Crop., having sieves of meshes of 53, 45 and 38 μm arranged in series. For evaluating the document offset, 2 g of the toner having been accurately weighed is placed on the sieve of a mesh of 53 μm, and vibration with an amplitude of 1 mm is applied thereto for 90 seconds. The amounts of the toner remaining on the respective sieves are measured, and the amounts are summed with weights of 0.5, 0.3 and 0.1, respectively. The value is calculated in terms of percentage and evaluated for the grades shown below.

AA: excellent 20% or less

A: good more than 20% and 30% or less

B: poor more than 30% and 40% or less

C: very poor more than 40%

The toner of Example 2-1 has a value of 11%, which is evaluated as grade AA.

Example 2-2

A toner 2-2 is obtained in the same manner as in Example 2-1 except that the same amount of the releasing agent particle dispersion liquid 2-2 is used instead of the releasing agent particle dispersion liquid 2-1.

The toner 2-2 has a volume average particle diameter D50v of 6.4 μm and a volume average particle diameter distribution index GSDv of 1.21, as measured with a particle size distribution measurement device. The toner has a glass transition temperature of 50.0° C. The toner has a shape factor SF1 of 132, which indicates a rounded potato shape, as observed with a Luzex image analyzer, produced by Nireco Corp.

(Results of Fixing Test)

The toner exhibits good releasing property in the fixing device, i.e., no offset occurs while the image is released with slight resistance. Upon evaluating the document offset, good results are obtained, i.e., no defects are formed on the images while the images are released from each other with slight resistance.

(Results of Toner Storage Test)

The toner exhibits a value of 23% for toner storage stability, which is evaluated as grade A.

Example 2-3

A toner 2-3 is obtained in the same manner as in Example 2-1 except that the same amount of the releasing agent particle dispersion liquid 2-3 is used instead of the releasing agent particle dispersion liquid 2-1.

The toner 2-3 has a volume average particle diameter D50v of 6.3 μm and a volume average particle diameter distribution index GSDv of 1.20, as measured with a particle size distribution measurement device. The toner has a glass transition temperature of 51.0° C. The toner has a shape factor SF1 of 132, which indicates a rounded potato shape, as observed with a Luzex image analyzer, produced by Nireco Corp.

(Results of Fixing Test)

The toner exhibits good releasing property in the fixing device, i.e., the image is released without resistance, and no offset occurs. Upon evaluating the document offset, good results are obtained, i.e., the images are released from each other without resistance.

(Results of Toner Storage Test)

The toner exhibits a value of 21% for toner storage stability, which is evaluated as grade A.

Example 2-4

A toner 2-4 is obtained in the same manner as in Example 2-1 except that the same amount of the releasing agent particle dispersion liquid 2-4 is used instead of the releasing agent particle dispersion liquid 2-1.

The toner 2-4 has a volume average particle diameter D50v of 6.4 μm and a volume average particle diameter distribution index GSDv of 1.21, as measured with a particle size distribution measurement device. The toner has a glass transition temperature of 51.2° C. The toner has a shape factor SF1 of 133, which indicates a rounded potato shape, as observed with a Luzex image analyzer, produced by Nireco Corp.

(Results of Fixing Test)

The toner exhibits good releasing property in the fixing device, i.e., no offset occurs while the image is released with slight resistance. Upon evaluating the document offset, good results are obtained, i.e., no defects are formed on the images while the images are released from each other with slight resistance.

(Results of Toner Storage Test)

The toner exhibits a value of 24% for toner storage stability, which is evaluated as grade A.

Comparative Example 2-1

A toner 2-5 is obtained in the same manner as in Example 2-1 except that the same amount of the releasing agent particle dispersion liquid 2-5 is used instead of the releasing agent particle dispersion liquid 2-1.

The toner 2-5 has a volume average particle diameter D50v of 6.7 μm and a volume average particle diameter distribution index GSDv of 1.21, as measured with a particle size distribution measurement device. The toner has a glass transition temperature of 47.0° C. The toner has a shape factor SF1 of 133, which indicates a rounded potato shape, as observed with a Luzex image analyzer, produced by Nireco Corp.

(Results of Fixing Test)

The toner exhibits poor releasing property in the fixing device, i.e., strong resistance occurs upon releasing the image. Upon evaluating the document offset, poor results are obtained, i.e., a clear impression of the image remains.

(Results of Toner Storage Test)

The toner exhibits a value of 70% for toner storage stability, which is evaluated as grade C.

Comparative Example 2-2

A toner 2-6 is obtained in the same manner as in Example 2-1 except that the same amount of the releasing agent particle dispersion liquid 2-6 is used instead of the releasing agent particle dispersion liquid 2-1.

The toner 2-6 has a volume average particle diameter D50v of 6.7 μm and a volume average particle diameter distribution index GSDv of 1.21, as measured with a particle size distribution measurement device. The toner has a glass transition temperature of 48.0° C. The toner has a shape factor SF1 of 133, which indicates a rounded potato shape, as observed with a Luzex image analyzer, produced by Nireco Corp.

(Results of Fixing Test)

The toner exhibits poor releasing property in the fixing device, i.e., strong resistance occurs upon releasing the image. Upon evaluating the document offset, poor results are obtained, i.e., a thin impression of the image remains.

(Results of Toner Storage Test)

The toner exhibits a value of 50% for toner storage stability, which is evaluated as grade C.

Comparative Example 2-2

A toner 2-7 is obtained in the same manner as in Example 2-1 except that the same amount of the releasing agent particle dispersion liquid 2-7 is used instead of the releasing agent particle dispersion liquid 2-1.

The toner 2-7 has a volume average particle diameter D50v of 6.3 μm and a volume average particle diameter distribution index GSDv of 1.21, as measured with a particle size distribution measurement device. The toner has a glass transition temperature of 51.8° C. The toner has a shape factor SF1 of 135, which indicates a potato shape, as observed with a Luzex image analyzer, produced by Nireco Corp.

(Results of Fixing Test)

The toner exhibits poor releasing property in the fixing device, i.e., strong resistance occurs upon releasing the image. Upon evaluating the document offset, poor results are obtained, i.e., a thin impression of the image remains.

(Results of Toner Storage Test)

The toner exhibits a value of 10% for toner storage stability, which is evaluated as grade AA.

The results of Examples 2-1 to 2-4 and Comparative Examples 2-1 to 2-3 are shown in Table 4 below.

TABLE 4

| | Releasing agent | Off-set | Releasing property | Tg (° C.) | Storage stability | Document offset |
|---|---|---|---|---|---|---|
| Example 2-1 | 2-1 | AA | AA | 51.5 | AA | AA |
| Example 2-2 | 2-2 | A | A | 50.0 | A | A |
| Example 2-3 | 2-3 | A | AA | 51.0 | A | AA |
| Example 2-4 | 2-4 | A | A | 51.2 | A | A |
| Comparative Example 2-1 | 2-5 | C | C | 47.0 | C | C |
| Comparative Example 2-2 | 2-6 | B | B | 47.5 | C | C |
| Comparative Example 2-3 | 2-7 | C | C51.5 | 51.8 | AA | B |

Example 3

| (Preparation of Resin Particle Dispersion Liquid 3) | |
|---|---|
| (Oily Phase) | |
| Styrene (produced by Wako Pure Chemical Industries, Ltd.) | 30 parts by weight |
| n-Butyl acrylate (produced by Wako Pure Chemical Industries, Ltd.) | 10 parts by weight |
| β-Carboxyethyl acrylate (produced by Rhodia Nicca, Ltd.) | 1.3 parts by weight |
| Dodecanethiol (produced by Wako Pure Chemical Industries, Ltd.) | 0.4 part by weight |
| (Aqueous Phase 1) | |
| Ion exchanged water | 17 parts by weight |
| Anionic surfactant (Dowfax, produced by Dow Chemical Inc.) | 0.4 part by weight |
| (Aqueous Phase 2) | |
| Ion exchanged water | 40 parts by weight |
| Anionic surfactant (Dowfax, produced by Dow Chemical Inc.) | 0.05 part by weight |
| Ammonium peroxo disulfate (produced by Wako Pure Chemical Industries, Ltd.) | 0.4 part by weight |

The components of the oily phase and the components of the aqueous phase 1 are mixed and stirred in a flask to obtain a monomer emulsion dispersion liquid. The components of the aqueous phase 2 are placed in a reaction vessel, and after sufficiently replacing the interior of the vessel with nitrogen, the reaction system is heated over an oil bath to 75° C. under stirring. The monomer emulsion dispersion liquid is gradually added dropwise to the reaction vessel over 3 hours to effect emulsion polymerization. After completing the dropwise addition, the polymerization is continued at 75° C. and then terminated after lapsing 3 hours.

The resulting resin particles have a volume average particle diameter D50v of 250 nm as measured with a laser diffraction particle diameter distribution measuring apparatus, LA-700, produced by Horiba, Ltd., a glass transition temperature of 52° C. as measured with a differential scanning calorimeter, DSC-50, produced by Shimadzu Corp. at a temperature increasing rate of 10° C. per minutes, a number average molecular weight (polystyrene conversion) of 13,000 as measured with a molecular weight measuring apparatus, HLC-8020, produced by Tosoh Corp. using THF as a solvent, and a melt viscosity of 17 mPa·s as measured at 180° C. with an E-type viscometer, produced by Tokyo Keiki Co., Ltd., having a cone angle of 1.34° at 60 rpm.

Accordingly, a resin particle dispersion liquid 3 having a volume average particle diameter of 250 nm, a solid content of 42%, a glass transition temperature of 52° C. and a number average molecular weight Mn of 13,000 is obtained.

(Preparation of Colorant Particle Dispersion Liquid)

A colorant particle dispersion liquid is obtained in the same manner as in Example 1.

| (Preparation of Releasing Agent Particle Dispersion Liquid 3-1) | |
|---|---|
| Releasing agent 3-1 | 50 parts by weight |
| Anionic surfactant (Neogen R-K, produced by Dai-ichi Kogyo Seiyaku Co., Ltd.) | 2 parts by weight |
| Ion exchanged water | 200 parts by weight |

The aforementioned components heated to 120° C. are sufficiently dispersed with Ultra Turrax T-50, produced by IKA Works Inc., to obtain a releasing agent particle dispersion liquid 3-1 having a volume average particle diameter of 250 nm and a solid content of 20%.

(Preparation of Releasing Agent Particle Dispersion Liquids 3-2 to 3-5)

Releasing agent particle dispersion liquids 3-2 to 3-5 are obtained in the same manner as in the preparation of the releasing agent dispersion liquid 3-1 except that the releasing agents 3-2 to 3-5, respectively, instead of the releasing agent 3-1. The releasing agent particle dispersion liquids 3-2 to 3-5 have a solid content of 30% and the following volume average particle diameters.

Releasing agent particle dispersion liquid 3-2 250 nm
Releasing agent particle dispersion liquid 3-3 250 nm
Releasing agent particle dispersion liquid 3-4 240 nm
Releasing agent particle dispersion liquid 3-5 255 nm The proportion of the component having a carbon number of 40 or less in the branched hydrocarbon component, the ratio (a/b×100), wherein a (J/g) represents an endothermic amount per unit amount at 50° C. or lower, and b (J/g) represents a total endothermic amount per unit amount, the melting point and the proportion of the linear hydrocarbon component of the releasing agents 3-1 to 3-5 are shown in Table 5 below.

Example 3-1

| | |
|---|---|
| Resin particle dispersion liquid 3 | 150 parts by weight |
| Colorant particle dispersion liquid | 30 parts by weight |
| Releasing agent particle dispersion liquid 3-1 | 40 parts by weight |
| Polyaluminum chloride | 0.4 part by weight |

The aforementioned components are sufficiently mixed and dispersed in a round-bottom stainless steel flask with Ultra Turrax T-50, produced by IKA Works Inc., and then heated to 48° C. over an oil bath for heating while stirring the content of the flask. After retaining at 48° C. for 80 minutes, 70 parts by weight of the same resin particle dispersion liquid is gradually added thereto.

Thereafter, the pH of the system is adjusted to 6.0 with a sodium hydroxide aqueous solution having a concentration of 0.5 mole/L, and then after sealing the stainless steel flask, the system is heated to 97° C. and maintained for 3 hours under continuous stirring using a stirring axis sealed with a magnetic seal. After completing the reaction, the system is cooled at a temperature descending rate of 1° C. per minute, filtered, sufficiently washed with ion exchanged water, and then subjected to solid-liquid separation by Nutsche suction filtration. The resulting product is again dispersed by using 3 L of ion exchanged water at 40° C. and stirred and washed at 300 rpm for 15 minutes. The washing operation is repeated 5 times, and at the time when the filtrate has pH of 6.54 and an electric conductivity of 6.5 μS/cm, the product is subjected to solid-liquid separation by Nutsche suction filtration using No. 5A filter paper. The product is then vacuum-dried for 12 hours to obtain a toner 3-1.

The toner 3-1 has a volume average particle diameter D50v of 6.2 μm and a volume average particle diameter distribution index GSDv of 1.20, as measured with a particle size distribution measurement device, and has a shape factor SF1 of 135, which indicates a potato shape, as observed with a Luzex image analyzer, produced by Nireco Corp. The toner has a glass transition temperature of 51° C. Silica ($SiO_2$) particles having a volume average particle diameter of 40 nm and having been subjected to a surface hydrophobic treatment with hexamethyldisilazane (hereinafter, sometimes abbreviated as HMDS) and metatitanate compound particles having a volume average particle diameter of 20 nm as a reaction product of metatitanic acid and isobutyltrimethoxysilane are added to the toner in such an amount that the coverages of the these kinds of particles are 40%, respectively, on the surface

TABLE 5

| Releasing agent | Material | Proportion of component having carbon number of 40 or less (% by mass) | Ratio (a/b × 100) | Melting point (° C.) | Proportion of linear hydrocarbon component (% by mass) |
|---|---|---|---|---|---|
| 3-1 | paraffin wax | 0.22 | 2.00 | 90 | 94 |
| 3-2 | microcrystalline wax | 0.83 | 0.80 | 87 | 75 |
| 3-3 | polyethylene wax | 0 | 2.40 | 98 | 100 |
| 3-4 | paraffin wax | 6.84 | 2.30 | 76 | 88 |
| 3-5 | paraffin wax | 2.88 | 2.50 | 86 | 92 |

of the toner particles, and then mixed with a Henschel mixer to obtain an electrophotographic toner 3-1.

(Powder Characteristics of Toner)

The storage stability and the fluidity of the toner thus produced are evaluated by the following aggregation degree test.

The toner is stored in an atmosphere at 50° C. for 24 hours, and the toner having been stored is placed on a sieve having a mesh of 105 μm. A prescribed vibration is applied to the sieve, and the amount of the toner remaining on the sieve is measured. The aggregation degree is calculated by the following equation to evaluate the storage stability. An aggregation degree of 20% or less is acceptable.

$$\text{Aggregation degree (\%)}=((\text{amount remaining on sieve})/(\text{initial amount}))\times 100$$

(Durability of Image)

For evaluating the thermal stability of a fixed image, images are superimposed to face each other, on which a load of 50 g/cm$^2$ is applied, and the assembly is allowed to stand in a chamber at a temperature of 50° C. and a humidity of 60% for 7 days to evaluate offset of images. As the evaluation standard, a case where the images can be released with no resistance and a case where the images are released with some resistance but no image defect occurs are evaluated as grade AA (excellent), a case where no image deterioration (no transfer of the image) occurs upon releasing the images is evaluated as grade A (good), a case where image deterioration (transfer of the image) occurs in an area of less than 50% is evaluated as grade B (poor), and a case where the image deterioration occurs in an area of 50% or more is evaluated as grade C (very poor).

The image is formed by using a modified machine of DocuColor 1250 with a toner coverage adjusted to 6 g/m$^2$, and fixed by using an external fixing device having no oil feeding device at a nip width of 6.5 mm and a fixing speed of 900 mm/sec. The fixing temperature is controlled by the surface temperature of the fixing roll and set at 180° C.

(Test Results)

The toner has a good aggregation degree of 10%, and the image obtained exhibits excellent thermal stability of grade AA.

Example 3-2

A toner 3-2 is obtained in the same manner as in Example 3-1 except that the same amount of the releasing agent particle dispersion liquid 3-2 is used instead of the releasing agent particle dispersion liquid 3-1.

The toner 3-2 has a volume average particle diameter D50v of 6.4 μm and a volume average particle diameter distribution index GSDv of 1.21, as measured with a particle size distribution measurement device. The toner has a glass transition temperature of 50° C. The toner has a shape factor SF1 of 135, which indicates a potato shape, as observed with a Luzex image analyzer, produced by Nireco Corp.

(Test Results)

The toner has a good aggregation degree of 11%, and the image obtained exhibits excellent thermal stability of grade AA.

Example 3-3

A toner 3-3 is obtained in the same manner as in Example 3-1 except that the same amount of the releasing agent particle dispersion liquid 3-3 is used instead of the releasing agent particle dispersion liquid 3-1.

The toner 3-2 has a volume average particle diameter D50v of 6.2 μm and a volume average particle diameter distribution index GSDv of 1.20, as measured with a particle size distribution measurement device. The toner has a glass transition temperature of 49° C. The toner has a shape factor SF1 of 131, which indicates a rounded potato shape, as observed with a Luzex image analyzer, produced by Nireco Corp.

(Test Results)

The toner has a good aggregation degree of 20%, and the image obtained exhibits good thermal stability of grade A.

Comparative Example 3-1

A toner 3-4 is obtained in the same manner as in Example 3-1 except that the same amount of the releasing agent particle dispersion liquid 3-4 is used instead of the releasing agent particle dispersion liquid 3-1.

The toner 3-4 has a volume average particle diameter D50v of 6.2 μm and a volume average particle diameter distribution index GSDv of 1.20, as measured with a particle size distribution measurement device. The toner has a glass transition temperature of 46° C. The toner has a shape factor SF1 of 132, which indicates a rounded potato shape, as observed with a Luzex image analyzer, produced by Nireco Corp.

(Test Results)

The toner has a poor aggregation degree of 68%, and the image obtained exhibits very poor thermal stability of grade C.

Comparative Example 3-2

A toner 3-5 is obtained in the same manner as in Example 3-1 except that the same amount of the releasing agent particle dispersion liquid 3-5 is used instead of the releasing agent particle dispersion liquid 3-1.

The toner 3-5 has a volume average particle diameter D50v of 6.4 μm and a volume average particle diameter distribution index GSDv of 1.20, as measured with a particle size distribution measurement device. The toner has a glass transition temperature of 48° C. The toner has a shape factor SF1 of 135, which indicates a potato shape, as observed with a Luzex image analyzer, produced by Nireco Corp.

(Test Results)

The toner has a poor aggregation degree of 40%, and the image obtained exhibits poor thermal stability of grade B.

Example 3-4

A toner 3-6 is obtained by using the releasing agent particle dispersion liquid 3-1 in the same manner as in Example 3-1 except that the cooling rate after fusing is changed to 0.2° C. per minute.

The toner 3-6 has a volume average particle diameter D50v of 6.4 μm and a volume average particle diameter distribution index GSDv of 1.21, as measured with a particle size distribution measurement device. The toner has a glass transition temperature of 49° C. The toner has a shape factor SF1 of 135, which indicates a potato shape, as observed with a Luzex image analyzer, produced by Nireco Corp.

(Test Results)

The toner has a good aggregation degree of 30%, and the image obtained exhibits poor thermal stability of grade B.

The results of Examples 3-1 to 3-4 and Comparative Examples 3-1 and 3-2 are shown in Table 6 below.

TABLE 6

| | Releasing agent | Material of Releasing agent | Tg of toner (° C.) | Aggregation degree of toner % | Aggregation degree of toner Evaluation | Thermal stability of image |
|---|---|---|---|---|---|---|
| Example 3-1 | 3-1 | paraffin wax | 51 | 10 | A | AA |
| Example 3-2 | 3-2 | micro-crystalline wax | 50 | 11 | A | AA |
| Example 3-3 | 3-3 | polyethylene wax | 49 | 20 | A | A |
| Comparative Example 3-1 | 3-4 | paraffin wax | 46 | 68 | C | C |
| Comparative Example 3-2 | 3-5 | paraffin wax | 48 | 40 | C | B |
| Example 3-4 | 3-1 | paraffin wax | 49 | 30 | A | B |

What is claimed is:

1. A toner for developing an electrostatic latent image, comprising:

a binder resin;

a colorant; and a releasing agent, the releasing agent comprises a hydrocarbon comprising a linear hydrocarbon, wherein:

the linear hydrocarbon has a carbon number distribution and an average carbon number N, wherein N is from 40 to 60 carbon atoms an amount of the linear hydrocarbon having a carbon number of from N−4 to N+4 in the releasing agent is 80% by mass or more based on the total mass of the hydrocarbon of the releasing agent, an amount of the linear hydrocarbon having a carbon number of N−10 or less in the releasing agent is 0.05% by mass or less based on the total mass of the hydrocarbon of the releasing agent, and an amount of the linear hydrocarbon having a carbon number of N+10 or more in the releasing agent is 0.05% by mass or less based on the total mass of the hydrocarbon of the releasing agent.

2. The toner according to claim 1, the hydrocarbon further comprising a branched hydrocarbon, wherein an amount of the branched hydrocarbon in the releasing agent is from 4 to 30% by mass based on the total mass of the hydrocarbon of the releasing agent.

3. The toner according to claim 1, wherein the releasing agent has a melt viscosity at 120° C. of from 1 to 9 mPa·s.

4. The toner according to claim 1, wherein a volume average particle diameter distribution index GSDv $(D84v/D16v)^{0.5}$ of the toner is 1.30 or less.

5. The toner according to claim 1, wherein a shape factor SF1 of the toner is from 110 to 140.

6. A toner for developing an electrostatic latent image, comprising:

a binder resin;

a colorant; and a releasing agent, the releasing agent comprising a hydrocarbon comprising a linear hydrocarbon and a branched hydrocarbon, wherein:

an amount of the branched hydrocarbon having a carbon number of 40 or less is 2% by mass or less based on the total mass of the hydrocarbon of the releasing agent, the releasing agent has a melting point of from 70 to 100° C., and the toner has a melting heat amount derived from the releasing agent of 17 J/g or less measured with a DSC.

7. The toner according to claim 6, wherein an amount of the branched hydrocarbon in the releasing agent is from 4 to 30% by mass based on the total mass of the hydrocarbon of the releasing agent.

8. The toner according to claim 6, wherein the releasing agent is at least one of a paraffin wax and a polyethylene wax, purified through crystallization from a solvent.

9. The toner according to claim 6, wherein the releasing agent is at least one of a paraffin wax and a polyethylene wax, which are purified through molecular distillation.

10. The toner according to claim 6, wherein the releasing agent has a melt viscosity at 120° C. of from 1 to 9 mPa·s.

11. The toner according to claim 6, wherein a volume average particle diameter distribution index GSDv $(D84v/D16v)^{0.5}$ of the toner is 1.30 or less.

12. The toner according to claim 6, wherein a shape factor SF1 of the toner is from 110 to 140.

13. A toner for developing an electrostatic latent image, comprising:

a binder resin;

a colorant; and a releasing agent, the releasing agent comprising a hydrocarbon comprising a linear hydrocarbon and a branched hydrocarbon, wherein:

an amount of the linear hydrocarbon in the releasing agent is 70% by mass or more based on the total mass of the hydrocarbon of the releasing agent, the branched hydrocarbon has a carbon number distribution, an amount of the branched hydrocarbon having a carbon number of 40 or less in the releasing agent is 2% by mass or less based on the total mass of the hydrocarbon of the releasing agent, and the releasing agent has an endothermic curve measured with a DSC, in which a ratio (b/a×100) is 2.5 or less, where a (J/g) represents an endothermic amount per unit amount at 50° C. or lower, and b (J/g) represents a total endothermic amount per unit amount.

14. The toner according to claim 13, wherein an amount of the branched hydrocarbon in the releasing agent is from 4 to 30% by mass based on the total mass of the hydrocarbon of the releasing agent.

15. The toner according to claim 13, wherein the releasing agent is at least one of a paraffin wax and a polyethylene wax, purified through crystallization from a solvent.

16. The toner according to claim 13, wherein the releasing agent is at least one of a paraffin wax and a polyethylene wax, which are purified through molecular distillation.

17. The toner according to claim 13, wherein the releasing agent has a melt viscosity at 120° C. of from 1 to 9 mPa·s.

18. The toner according to claim 13, wherein a volume average particle diameter distribution index GSDv $(D84v/D16v)^{0.5}$ of the toner is 1.30 or less.

* * * * *